US005220931A

United States Patent [19]

Aida

[11] Patent Number: 5,220,931

[45] Date of Patent: Jun. 22, 1993

[54] HAIRDRESSING KIT

[75] Inventor: Masaaki Aida, Tokyo, Japan

[73] Assignee: Midori Co., Ltd., Tokyo, Japan

[21] Appl. No.: 970,239

[22] Filed: Nov. 2, 1992

Related U.S. Application Data

[63] Continuation of Ser. No. 734,688, Jul. 23, 1991, abandoned.

[51] Int. Cl.[5] ..... A45D 4/16

[52] U.S. Cl. ..... 132/233; 132/269; 132/271; 34/99; 34/100; 34/104; 219/222; 219/226; 219/242

[58] Field of Search ..... 132/212, 229, 233, 261, 132/269, 271, 272, 314; 34/96, 97, 98, 99, 100, 101, 104, 106; 219/222, 226, 242

[56] References Cited

U.S. PATENT DOCUMENTS

| | | | |
|---|---|---|---|
| 3,159,466 | 12/1964 | Nissman | 34/99 |
| 3,415,254 | 12/1968 | Brock et al. | 132/233 |
| 3,584,632 | 6/1971 | Weidner et al. | 132/271 |
| 3,658,071 | 4/1972 | Wise | 132/233 |
| 3,802,092 | 4/1974 | Meyerhoefer | 34/99 |
| 3,858,029 | 12/1974 | Walter | 132/229 |
| 3,990,460 | 11/1976 | Shalvoy | 132/271 |
| 4,021,930 | 5/1977 | Churas et al. | 34/99 |
| 4,197,448 | 4/1980 | Harigai | 132/212 |
| 4,198,558 | 4/1980 | Benty | 132/212 |
| 4,214,597 | 7/1980 | Glassman | 132/269 |
| 4,293,760 | 10/1981 | Smal | 132/233 |
| 4,516,011 | 5/1985 | Jeffress et al. | 132/229 |
| 4,685,479 | 8/1987 | McClean | 132/229 |
| 4,744,154 | 5/1988 | Bollinger et al. | 34/100 |
| 4,926,027 | 5/1990 | Montagino et al. | 132/271 |

*Primary Examiner*—Gene Mancene
*Assistant Examiner*—Frank A. LaViote
*Attorney, Agent, or Firm*—Wenderoth, Lind & Ponack

[57] ABSTRACT

A hairdressing kit combining a hair heating function with a haircurling function includes a hair dryer having a cylindrical air blower, cylindrical hair curlers, receivers for receiving the air blower of the hair dryer and the curlers detachably, and a casing body of an adiabatic structure through which the blower receiver communicates with the curler receivers.

2 Claims, 4 Drawing Sheets

HAIRDRESSING KIT

This application is a Rule 1.62 continuation of now abandoned application, Ser. No. 07/734,688, filed Jul. 23, 1991, now abandoned.

BACKGROUND OF THE INVENTION

1. Field of the Invention

The present invention relates to a hairdressing kit and, more particularly, to a hair dressing kit which combines a hair heating function with a haircurling function and is suitable to carry.

b 2. Prior Art

Usually, a hair dryer for hairdressing and a curler dryer for haircurling have been provided so separately that a serious inconvenience, for instance, is experienced during journey, etc., since it is required to carry the hair dryer separately from the curler dryer.

In view of the foregoing, the present invention seeks to provide a hairdressing kit which combines a hair heating function with a haircurling function and is convenient to carry.

SUMMARY OF THE INVENTION

According to this invention, the above-mentioned object is to provide a hairdressing kit including a hair dryer having a cylindrical air blower, a cylindrical hair curler, receivers for receiving the air blower of said hair dryer and said curler detachably, and a casing body of an adiabatic structure through which said blower receiver communicates with said curler receiver.

BRIEF DESCRIPTION OF THE DRAWINGS

The present invention will now be explained in greater detail with reference to the accompanying drawings, which are given for the purpose of illustration alone, and in which.

DESCRIPTION OF THE PREFERRED EMBODIMENTS

Figure 1:
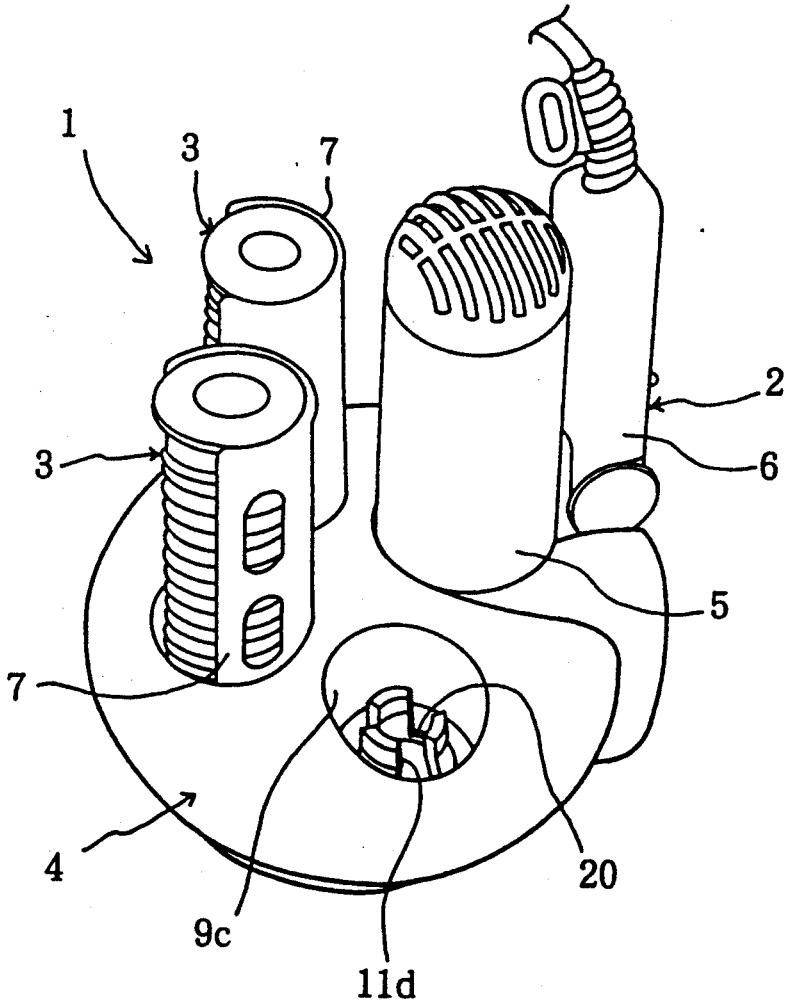
FIG. 1 is a perspective view of one embodiment of this invention.
Figure 2:
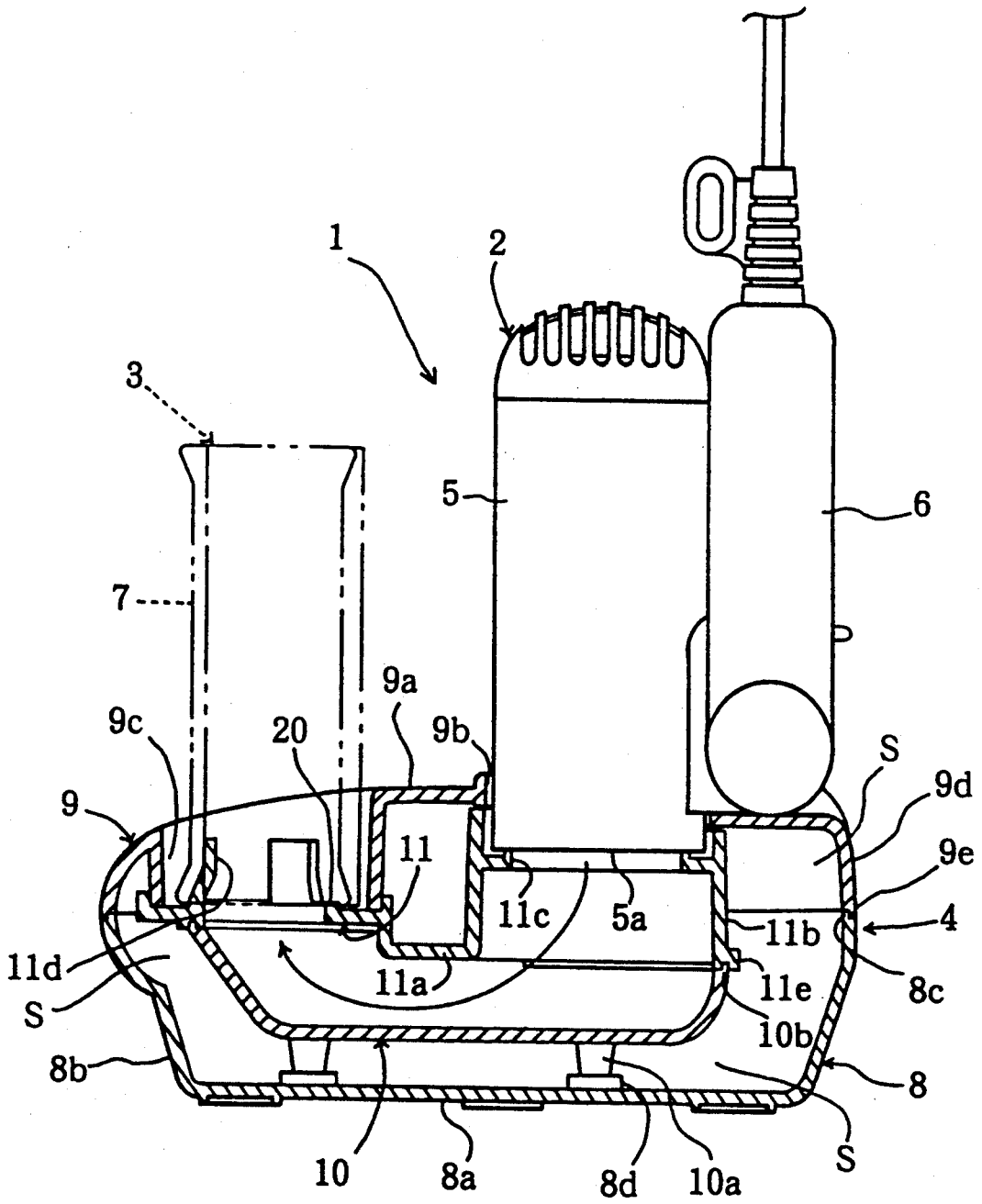
FIG. 2 is a sectional view of that embodiment in use.

Referring to FIGS. 1 and 2, a hairdressing kit shown generally at 1 includes a small-sized dryer 2, a plurality of hair curlers 3 or three hair curlers for example, and a casing body 4 for receiving them detachably.

The hair dryer 2 includes a cylindrical member 5 with a motor, a heater, etc. built in it and a grip 6 attached to the member 5 such that it is bendable at an angle of 90° with respect to that cylindrical member 5. A cylindrical air blower 5*a* is provided at an extreme end of the member 5, and extends beyond the grip 6.

Said curler 3 in a substantially cylindrical form produces a haircurling function in a heated state, and is fitted thereover with a detachable curler cover 7.

Figure 3:
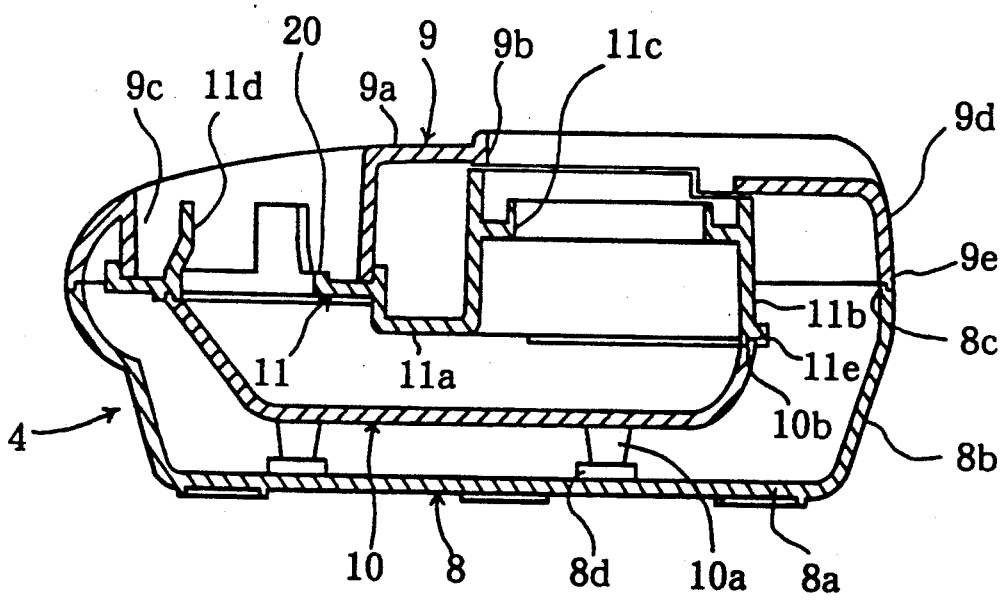
FIG. 3 is a sectional view of the casing body of that embodiment.

As also illustrated in FIG. 3, the casing body 4 by and large is substantially in a disc form, comprising four parts, i.e., main case 8, upper case 9 provided on the main case 8, internal frame 10 interposed between the main case 8 and the upper case 9 and mounting frame 11.

Assuming on a dish form as a whole, the main case 8 comprises a bottom plate 8*a* and side plates 8*b* vertically extending from the bottom plate 8*a*. Each or the side plate 8*b* includes at its upper end a piece 8*c* engageable with the upper case 9.

The upper case 9 includes an upper lid 9*a* with which the upper portion of the case 8 is covered, and the lid 9*a* is provided with a hole 9*b* through which the air blower 5*a* of the hair dryer 2 is insertable and three curler holes 9*c* through which the curlers 3 are insertable. A piece 9*e* engageable with the piece 8*c* is provided on a peripheral portion 9*d* of the upper lid 9*a*.

Taking a dish form smaller than the form of the main case 8, the internal frame 10 is provided on the bottom with legs 10*a*, which are placed on leg-receivers 8*d* of the main case 8, thereby spacing the internal frame 10 away from the main case 8. The internal frame 10 is provided on the upper end with an engaging portion 10*b*.

The mounting frame 11 is integrally provided with an upper plate 11*a* located above the internal frame 10 and a side plate 11*b*, and includes an substantially circular arrangement comprising a cylindrical air blower receiver 11*c* in which the air blower 5*a* of the hair dryer 2 can be fitted and three curler receivers 11*d* in which the curlers 3 can be fitted. From the vicinity of the curler receivers 11*d* to the lower end of the side plate 11*b*, there is provided an engaging receiver 11*e* engageable with the engaging portion 10*b*.

In the casing body 4 constructed as above, there is defined an adiabatic space S which is formed between the main case 8 and the internal frame 10 and extends to the inside of the upper case 9 and the outside of the mounting frame 11.

According to the hairdressing kit 1 of this invention, it is noted that no limitation is imposed upon how many the curler holes 9*c* and curler receivers 11*d* are to be provided. Throughout FIGS. 3–3, reference numeral 20 stands for a wall preventing a hot air from the air blower 5*a* of the hair dryer 2 from escaping through slight gaps left at the lower ends of the curler receivers 11*d*, when the curlers 3 fitted into the associated receivers 11*d* are heated.

In what follows, how to use the hairdressing kit 1 will be explained with reference to FIGS. 1–4.

As illustrated in FIGS. 1 and 2, the air blower 5*a* of the hair dryer 2 is fitted into the associated receiver 11*c* of the mounting frame 11, and the three curlers 3 with the covers 7 are fitted into the associated three receivers 11*d*. When the hair dryer 2 is switched on by connection to a commercial power source (AC 100 V) and the hair dryer 2 begins to operate, a hot air flows from the air blower 5*a* through a passage between the frames 10 and 11 in a direction shown by an arrow in FIG. 2, thereby heating the curlers 3 fitted in the associated receivers 11*d*. After the curlers 3 are heated for a given time (say, for 30 seconds), the hair dryer 2 is switched off with the removal of the curlers 3, which can in turn be used for haircurling.

Figure 4:
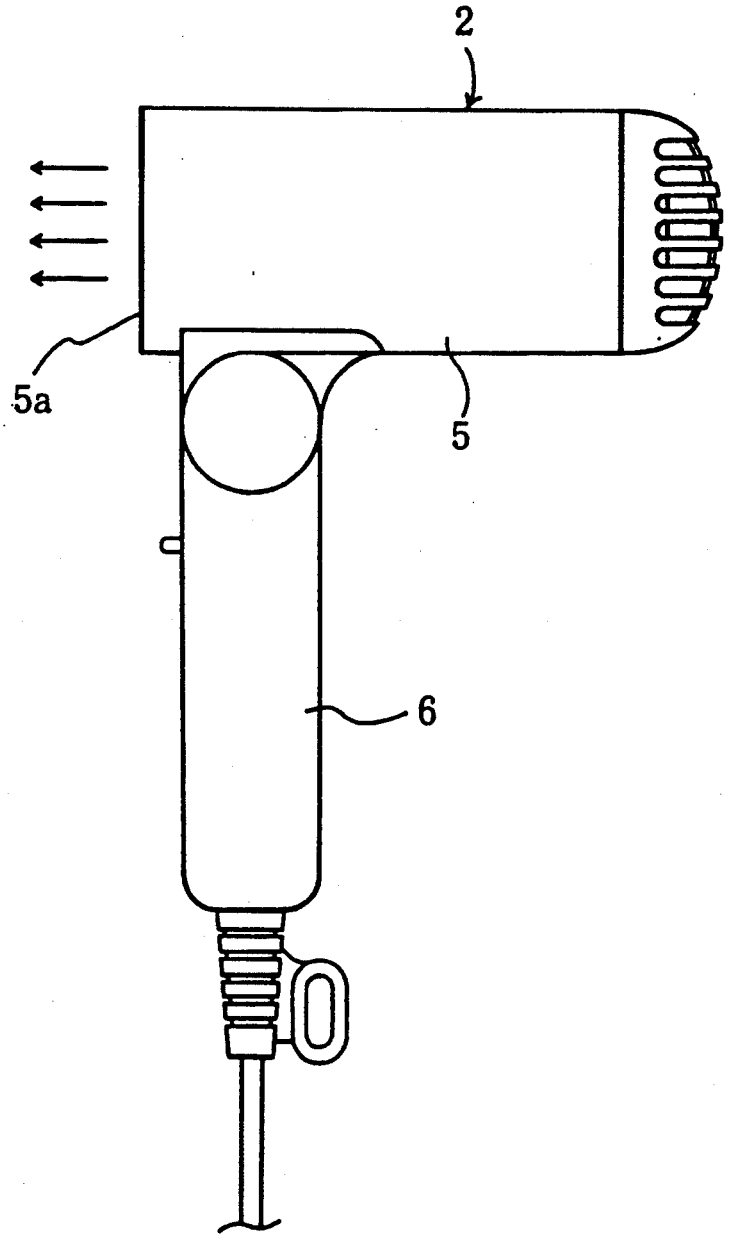
FIG. 4 is a side view of a hair dryer.

When it is intended to use the hair dryer 2 by itself, on the other hand, it is pulled out of the associated receiver 11*c*, and the grip 6 is bent at an angle of 90° as shown in FIG. 4. Then, the hair dryer 2 is connected to a commercial power source and switched on to produce a hot air from the air blower 5*a* for hairdressing.

For carrying the hairdressing kit 1, the hair dryer 2, curlers 3 and casing body 4 may be separately packed in a suitable case, not illustrated. Thus, this kit can be very easily carried during journey and other occasions.

According to the present invention as detailed above, there is provided a hairdressing kit which permits hairdressing and haircurling to be performed selectively and is very convenient to carry.

While the invention has been described in detail and with reference to one specific embodiment thereof, it will be apparent to one skilled in the art that various changes and modifications may be made thereto without departing from the scope thereof. For instance, a hair brush may be attached to one curler receiver for heating it.

What is claimed is:

1. A hairdressing kit comprising:

a hair dryer having a cylindrical air blower portion;

at least one cylindrical hair curler; and a casing for holding said hair dryer and said hair curler, said casing having a dish-shaped main case, a dish-shaped internal frame therewithin spaced from an inner surface of said main case to define an air space between said main case and said internal frame, an upper case mounted over said main case and having a blower receiving cylindrical recess for receiving the blower portion of said hair dryer and at least one curler receiving recess for receiving a curler, and a mounting frame within said upper case and mounted over said internal frame, said mounting frame having a cylindrical mounting portion for receiving and supporting said blower through said blower receiving cylindrical recess and a further cylindrical mounting portion for receiving and supporting a curler through said curler receiving recess, said mounting frame defining with said internal frame an air passage extending along said internal frame from said blower receiving cylindrical recess to said curler receiving recess, said air passage being completely enclosed relative to said air space, said air space acting as an insulating space between said internal frame defining said air passage and the exterior of said casing to reduce escape of heat from hot air being blown along said air passage from said dryer to a curler.

2. A hairdressing kit as claimed in claim 1 in which there are a plurality of curlers, a plurality of curler receiving recesses and a plurality of further cylindrical mounting portions.

* * * * *